US005515945A

United States Patent [19]

Smith et al.

[11] Patent Number: 5,515,945

[45] Date of Patent: May 14, 1996

[54] MULTI-STAGE MAST ASSEMBLY FOR PORTABLE LIFTS

[75] Inventors: Paul K. Smith, Kirkland; Richard M. Curtin, Redmond; Matthew G. Kraemer, Seattle, all of Wash.

[73] Assignee: Genie Industries, Inc., Redmond, Wash.

[21] Appl. No.: 229,295

[22] Filed: Apr. 18, 1994

[51] Int. Cl.[6] ..... B66F 9/08

[52] U.S. Cl. ..... 187/226; 187/406

[58] Field of Search ..... 187/406, 410, 187/226, 235, 238

[56] References Cited

U.S. PATENT DOCUMENTS

| | | | |
|---|---|---|---|
| 670,466 | 3/1901 | Bolander | 187/410 X |
| 2,973,835 | 3/1961 | Quayle | 187/226 x |
| 3,851,732 | 12/1974 | Wagner et al. | 187/238 |
| 4,015,686 | 4/1977 | Bushnell, Jr. | 187/235 X |
| 4,635,757 | 1/1987 | Yamagishi et al. | 187/238 X |

FOREIGN PATENT DOCUMENTS

| | | | |
|---|---|---|---|
| 546321 | 6/1993 | European Pat. Off. | 187/238 X |
| 2086843 | 5/1982 | United Kingdom | 187/226 X |

*Primary Examiner*—William E. Terrell
*Assistant Examiner*—Dean A. Reichard
*Attorney, Agent, or Firm*—Seed and Berry

[57] ABSTRACT

A multi-stage mast assembly has its mast stages stacked front to back when retracted and has front-to-back guide rollers and side-to-side guide rollers between the mast stages and a front carriage frame. An extrusion is used for the mast stages and the carriage frame. The extrusion has a central hollow rectangular column, inwardly facing channels at the front corners, outwardly directed flanges at the back corners, and pairs of central stub flanges at the front and back.

13 Claims, 5 Drawing Sheets

MULTI-STAGE MAST ASSEMBLY FOR PORTABLE LIFTS

TECHNICAL FIELD

The present invention relates to portable multi-stage lifts in which the stages stack front to back when retracted and are extended to raise a front carriage by operation of a reeving system operated by a winch at the back.

BACKGROUND OF THE INVENTION

U.S. Pat. No. 4,015,686 discloses a multi-stage lift which has been in commercial production for many years. In this lift the stages comprise like extruded aluminum mast sections which interfit in front to back relation and are separated in the front to back direction by guide rollers. These rollers track between laterally extending flanges at the back of each mast section and interfitting front flanges on the adjoining mast section. These front flanges extend inwardly as part of front channels which face inwardly toward one another. Stub shafts for the rollers extend through the central wall of these front channels. The front channels and interfitting back flanges of adjoining mast sections extend from central hollow columns of generally rectangular cross-section. A reeving system for a cable from a rear winch to a front carriage on the mast includes tilted pulleys adjacent the bottom of the mast sections and laterally extending pulleys at the front of the central column portions of the mast sections.

The described prior art mast construction does not provide for any roller alignment of the mast sections from side to side while they are extended and retracted. Such alignment is only provided by friction contact by the ends of the front-to-back guide rollers with the adjacent outer side faces of the adjoining mast section. Accordingly, a major objective of the present invention is to provide an improved mast configuration which will provide side-to-side roller contact between adjoining mast stages as well as front-to-back roller contact.

SUMMARY OF THE INVENTION

In carrying out the present invention the mast section extrusions are modified to provide pairs of stub flanges projecting forwardly and rearwardly from the front wall and the back wall of the central hollow column portion. The pair of rear laterally extending flanges on the mast section are stepped rearwardly so that their rear faces are located as far back as the rear edges of the added pair of rear stub flanges. Side-to-side guide rollers are mounted on each central column portion to project and track between the inner end of one of the back flanges of the adjoining mast section and the adjacent rear stub flange. By this arrangement, the added side-to-side rollers provide side-to-side guiding of the mast stages relative to one another.

To enable the described side-to-side roller improvement to be provided, the pulley arrangement is changed from before so that pulleys no longer occupy a laterally extending position at the front of the mast sections. Instead, all of the pulleys are tilted and pass through cutouts in the front or rear walls of the central column portion of the mast sections. Mounting blocks with sloped outer faces corresponding to the tilt of the pulleys are provided in the column portion of each mast section to support the axle bolts for the pulleys.

DETAILED DESCRIPTION OF THE INVENTION

Figure 1:
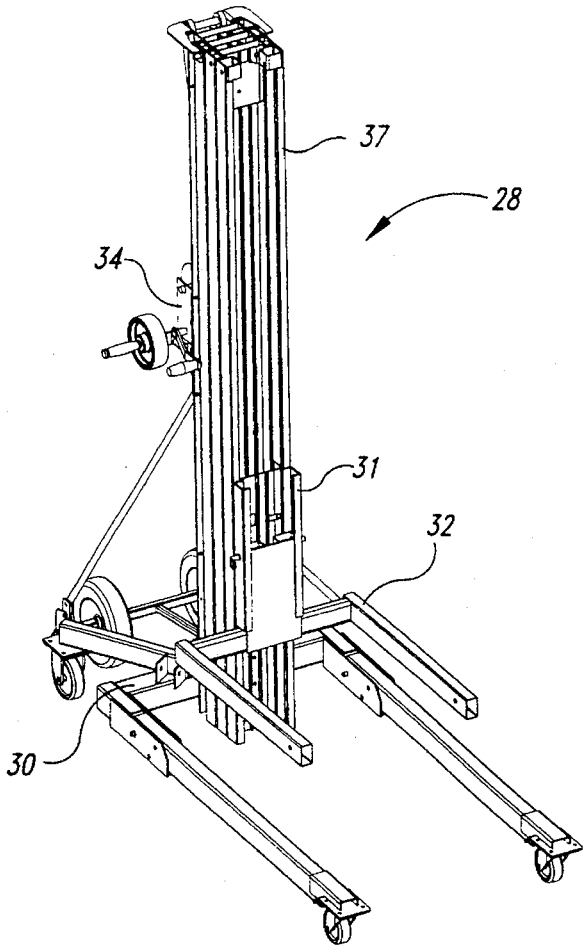
FIG. 1 is a perspective view of a portable lift to which the invention has been applied.

Referring to FIG. 1, the present invention is illustrated as applied to a multi-stage lift 28 having a mobile base assembly 30 supported on casters. The lift has a front carriage section 31 which can carry a load support 32. At the rear the lift has a winch 34 which may be manually operated or can be a motor driven unit. The winch is mounted on the rear of a back stationary mast stage 35. For purposes of example two extensible mast stages 36–37 have been illustrated between the back stage 35 and the carriage 31.

Figure 2:
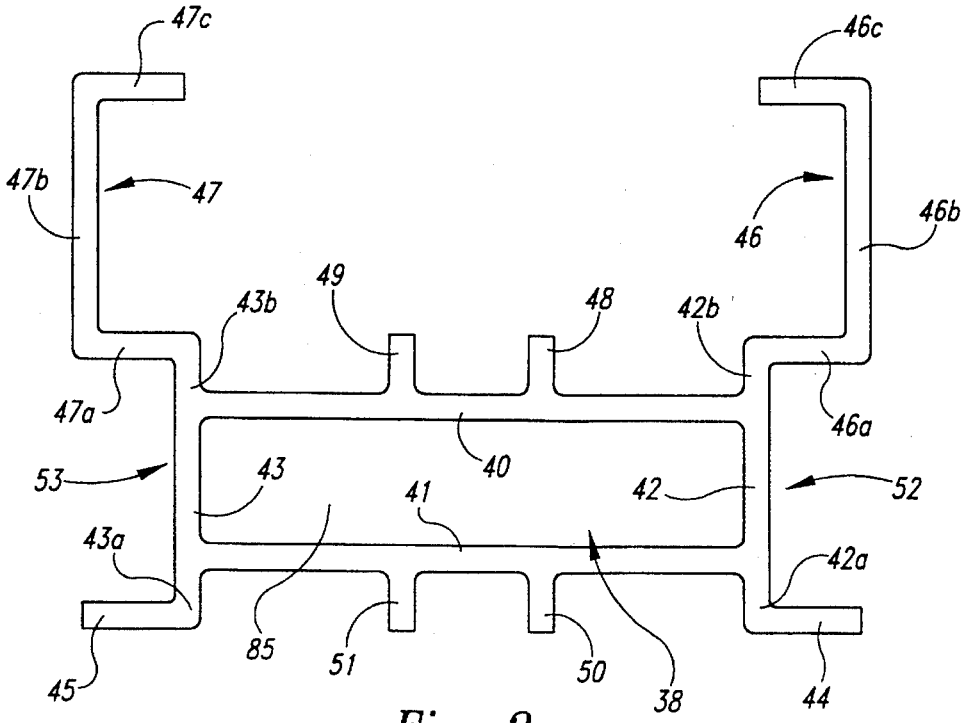
FIG. 2 is an end view of an extruded aluminum section made in accordance with the invention.

The mast stages 35–37 and carriage 31 are preferably identical in cross-section and comprise a length of extruded aluminum bar stock whose cross-section is shown in FIG. 2. It will be seen that each mast stage has a central hollow column 38 of generally rectangular cross-section having front and back walls 40–41 and a pair of right and left side walls 42–43 extending therebetween. At the rear of the column 38 the side walls 42–43 continue rearwardly at **42*a*–43*a* and join back laterally extending flanges 44–45. At the front of the column the side walls 42–43 continue forwardly at 42*b*, 43*b* and join right and left inturned front channels 46–47 comprising outwardly extending central flanges 46*a*–47*a*, outside sections 46*b*–47*b*, and inturned front flanges 46*c*–47*c*. The front and rear walls 40–41 have respectively, a forwardly projecting pair of stub flanges 48–49 and a rearwardly projecting pair of stub flanges 50–51. The front stub flanges 48–49 are slightly offset to the right relative to the rear stub flanges 50–51. It will be noted that the central flanges 46*a*–47*a* together with the walls 42–43 and back flanges 44–45 define right and left outwardly facing back channels 52–53**.

Figure 4:
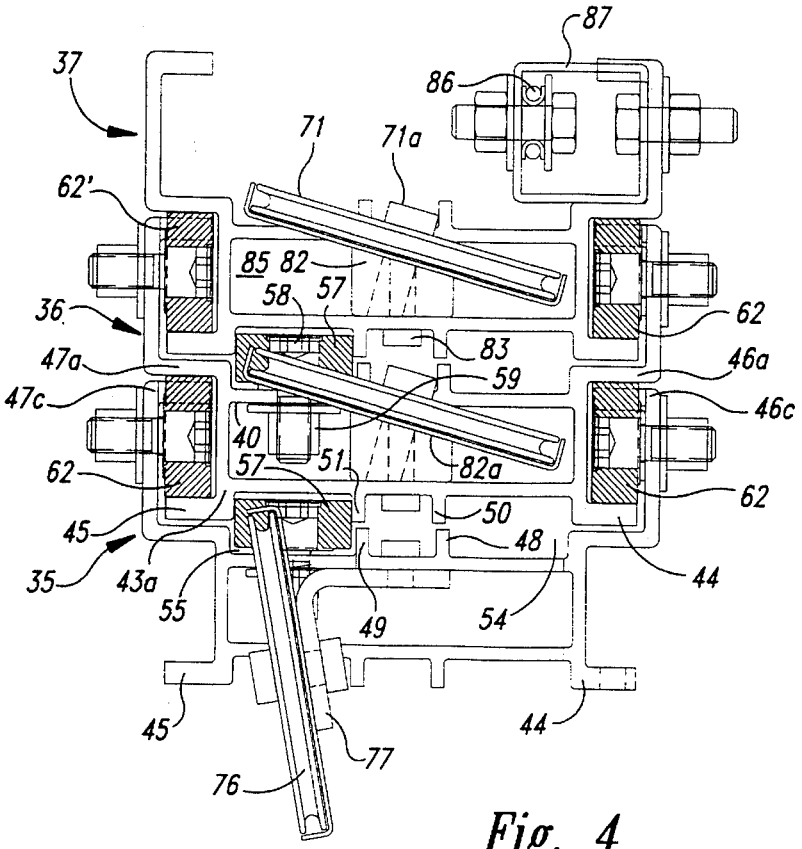
FIG. 4 is a top view of the mast stages without the carriage.
Figure 5:
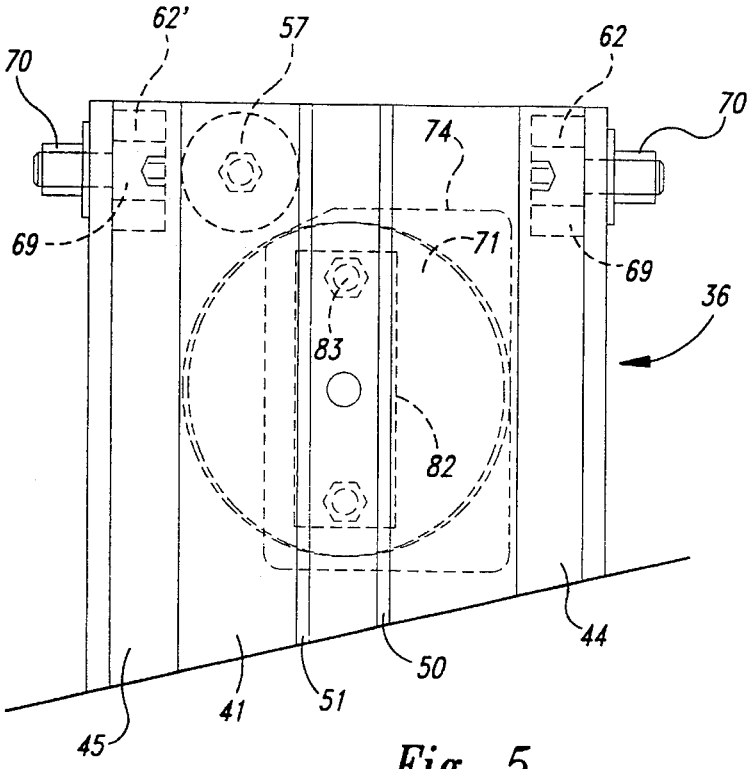
FIG. 5 is a fragmentary elevational view of the back of the front extensible mast stage and showing the position of the related side-to-side roller in broken lines which is mounted directly behind.
Figure 6:
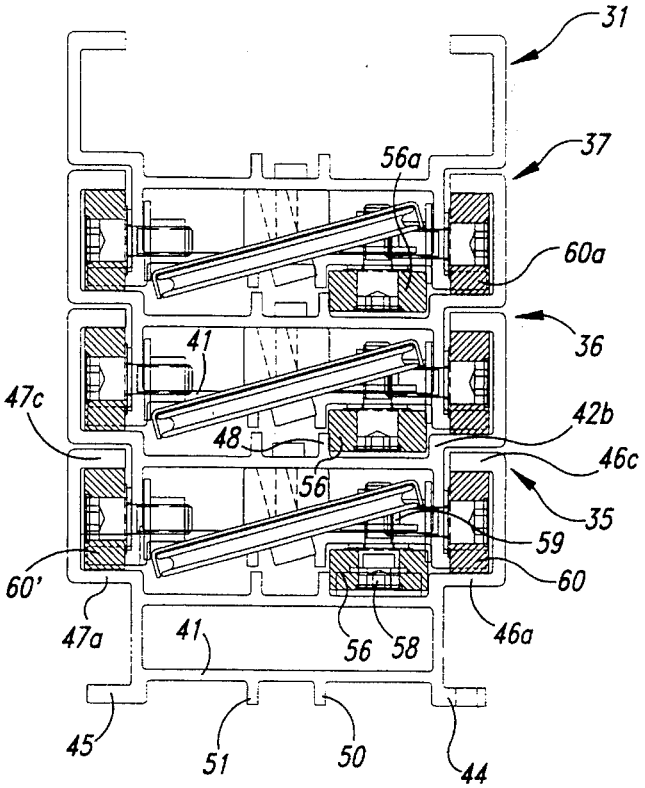
FIG. 6 is a transverse sectional view through the mast stages and carriage when the carriage is in a lowered position, taken as indicated by line 6—6 in FIG. 7, and without section lines on the mast extrusions.
Figure 9:
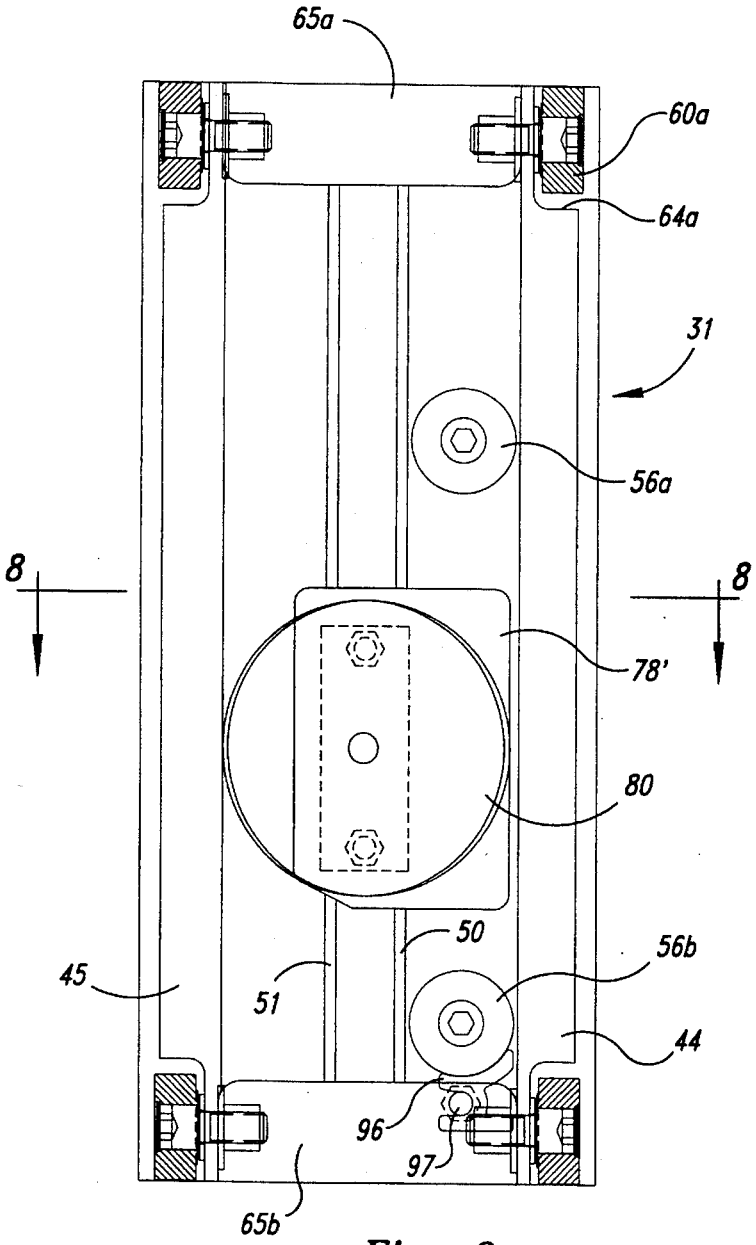
FIG. 9 is a rear elevational view of the carriage.

Directing attention to FIG. 4, the described mast stage configuration enables the front inturned channels 46–47 of one mast stage to interfit with the back out-turned channels 52–53 of a second mast stage with the back flanges 44–45 of the front stage facing the front of the central flanges **46*a*–47*a* of the back stage, and the front flanges 46*c*–47*c* of the back stage facing the rear of the central flanges 46*a*–47*a*** of the front stage. When mast stages 35–37 are interfitted as described, the rear stub flanges 50–51 of the front mast stage are opposite the front stub flanges 48–49 of the adjacent rear mast stage, but slightly offset to the left. As a result the interfitting mast stages provide therebetween right and left longitudinal passages 54–55. These passages house right (FIG. 6) and left (FIG. 4) side-to-side rollers 56–57 on shaft bolts 58 passing through the back wall 41 of the front interfitting mast stage and the front wall 40 of the rear interfitting mast stage, respectively, to receive a washer and retaining nut 59. Each right side-to-side roller 56 tracks on the right face of the right front stub flange 48 of the rear interfitting mast stage, or the left face of the right wall extension **42*b* of the rear interfitting mast stage as can be seen in FIG. 6 by reference to the roller 56 mounted on stage 37. Similarly, each left side-to-side roller 57 tracks on the left face of the left rear stub flange 51 of the front interfitting mast stage, or the right face of the left wall extension 43*a* of the front interfitting mast stage as can be seen in FIG. 4 by reference to the roller 57 mounted on stage 35. In the illustrated lift having a stationary mast stage 35, two extensible mast stages 36–37 and a carriage 31, four right side-to-side rollers 56 are provided, namely, one between mast stages 35–36, another between stages 36–37, and the remaining two between the carriage 31 and front stage 37. Two left side-to-side rollers 57 are provided, one between mast stages 35–36, and the other between stages 36–37. The right rollers 56 between the mast stages 35–36 and 36–37 are positioned near the bottom thereof and the positioning of those on the carriage (designated 56*a*–56*b*) is shown in FIG. 9**. The two left side-by-side rollers to keep the mast stages and carriage laterally aligned is by way of example only.

Figure 7:
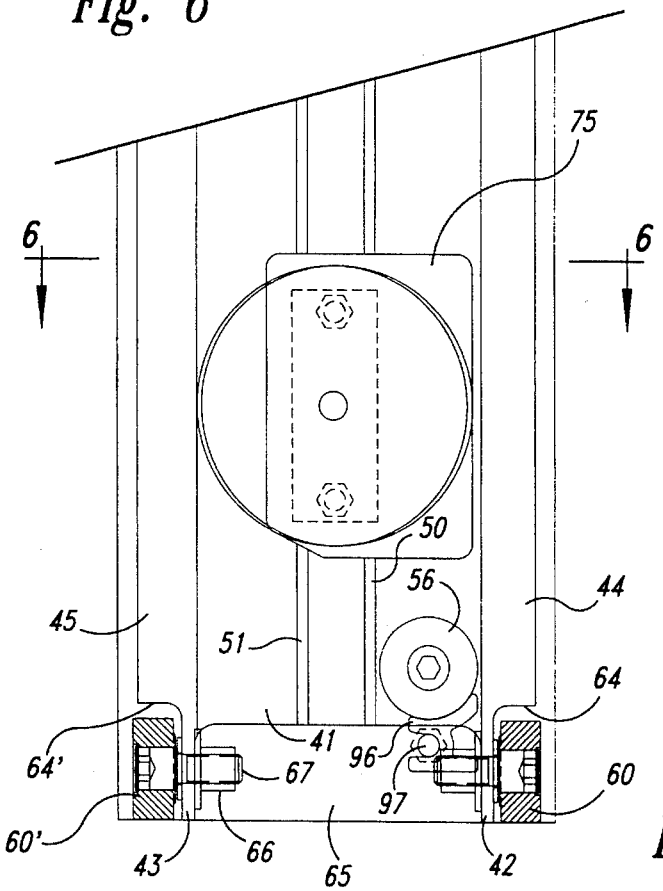
FIG. 7 is a fragmentary rear elevational view of the rear extensible mast stage.

Front to back alignment of the mast stages is provided by bottom front-to-back pairs of rollers 60—60' on mast stages 35, 36 and 37, and top front-to-back pairs of rollers 62—62' on stages 35–36. Cutouts 64—64' are provided at the bottom of the back flanges 44–45 of the mast stages, and a central bottom cutout 65 is provided in the back wall 41 and back stub flanges 50–51 of the mast stages as seen in FIG. 7. These cutouts 65 provide operating space for the rear portion of the bottom rollers 60—60' and access to washers and nuts 66 on the bolt shafts 67 for these rollers passing through the right and left walls 42–43. Space for the front portion of the top rollers 62—62' is provided by top cutouts 68 in the front flanges **46*c*–47*c*. The shaft bolts 69 for the top rollers 62—62' pass outwardly through the outside sections 46*b*–47*b* to receive washers and nuts 70. With the described arrangement of front-to-back rollers, the bottom rollers 60—60' track on the rear face of the front inturned flanges 46*c*–47*c* or the front face of the intermediate flanges 46*a*–47*a* of the rear mast stage of interfitting mast stages. Similarly, the top front-to-back rollers 62—62' track on the front face of the rear out-turned flanges 44–45 or the back face of the intermediate flanges 46*a*–47*a* of the front stage of interfitting mast stages. As shown in FIG. 9, the carriage 31 has front-to-back rollers 60*a* adjacent its four corners mounted in the same manner as the rollers 60—60'. Corner cutouts 64*a* and top and bottom central cutouts 65*a–b* are provided like the cutouts 64 and 65** in the mast sections.

Figure 3:
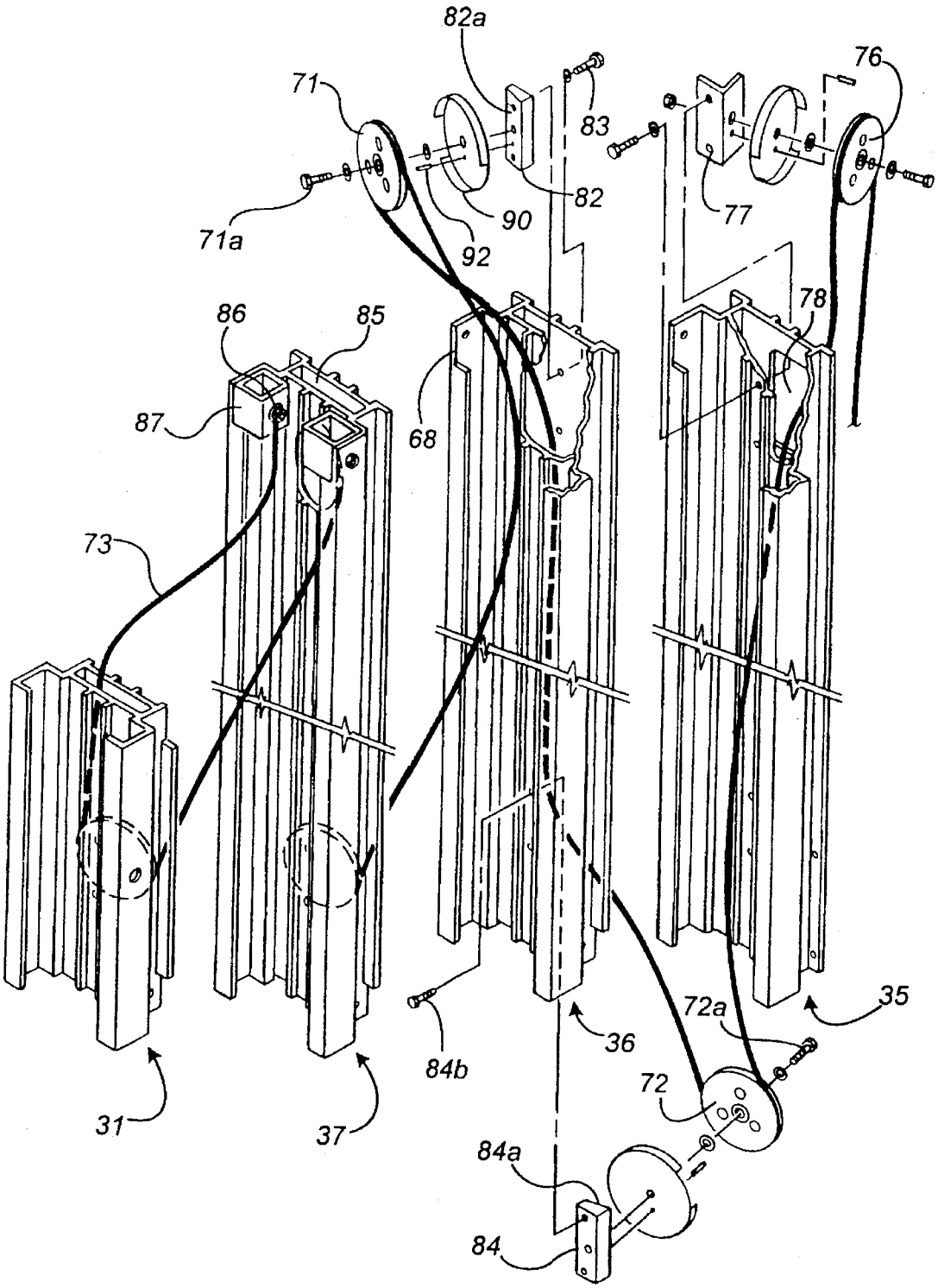
FIG. 3 is an exploded view illustrating the reeving arrangement for the carriage and mast stages of the lift.

Referring to FIG. 3, each of the extensible mast stages 36–37 has a top pulley 71 and a bottom pulley 72 adjacent its ends for receiving a cable 73, from the winch 34. Each top pulley 71 extends through a cutout 74 in the front wall 40 of the respective mast stage, and each bottom pulley 72 extends through a cutout 75 in the back wall 41 of the respective mast stage. The rear stationary mast stage 35 has a single upper pulley 76 journal-mounted on an angle bracket 77 mounted on its front wall and extending through registering cutouts 78 in the front and back walls thereof. The carriage 31 has a pulley 80 extending through a cutout 78' in its back wall. The top pulleys 71 are journaled on shaft bolts **71*a* mounted in blocks 82 fixed by bolts at 83 to the back wall 41 of the respective mast stage, and the lower pulleys 72 are journaled on shaft bolts 72*a* passing through blocks 84 fixed by bolts 845 to the front wall 40** of the respective mast stage.

The blocks 82, 84 have front beveled faces **82*a*, 84*a*, respectively, angled so that the respective pulleys are tilted in an upright plane. The two upper pulleys 71 are tilted such as to extend rearward into the right portion of the center passage 85 along the column portion 38 of the respective mast stage from the left passage 55 in front of the stage. The two lower pulleys 72 and the carriage pulley 80, on the other hand, angle rearward from the right portion of the central passage 82 to the left passage 55 which is next to the rear. This positions the pulleys such that the cable 72 extends from a stop 86 on the upper end of the front mast stage 37, travels under the carriage pulley 80, then over the top pulley 71 and under the bottom pulley 72 of the extensible mast stages 37, 36 progressing from front to back, then travels over the top pulley 76 on the back stationary mast stage 35 and down to the winch 34. The stop 86 extends from an insert 87 secured into the top of the right channel portion 46 of the front mast stage 37**.

Figure 8:
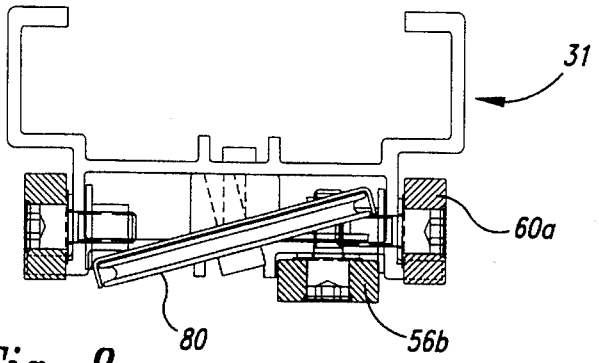
FIG. 8 is a horizontal sectional view taken as indicated by line 8—8 in FIG. 9 and without sections lines on the carriage extrusion.

It is preferred to provide the pulleys 71, 72, 76 and 80 with guards 90 (FIG. 3) which are sleeved on the shaft bolts which extend through the pulleys into the tapered blocks 82, 84. Dowel pins 92 extending from the blocks 82, 84 through openings in the pulleys keep the guards 90 properly oriented. The top rollers may also be shielded by angle shaped shields through which the shaft bolts for the rollers extend. Bottom stops 96 held by bolts 97 (FIG. 8) are provided on the front of the mast stages 35–37 near the lower right corner for engagement by the bottom side-to-side rollers 56 on the carriage 31 and stages 36–37. Stops are also provided to engage the top rollers to limit upward travel of the carriage 31 and extensible stages 36–37.

From the foregoing description it is seen that the carriage 31 and the extensible mast sections 36–37 are roller guided front-to-back and side-to-side for smooth up and down travel. When cable is taken up on the winch 34, first the carriage 31 travels up the mast stage 37. Then the front extensible stage 37 is raised following which the next stage 36 is raised. It will be apparent that additional extensible mast sections can be added which duplicate stage 36.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A multi-stage mast comprising:

a back stationary mast stage;

a front vertically movable mast stage;

an intermediate mast stage between said front and back stages and slidably interfitting therewith such that said intermediate stage can extend upwardly relative to said stationary stage, and said front stage can extend upwardly relative to said stationary and intermediate stages;

said stages having the same width and cross-section and having a central upright column section;

front-to-back guide rollers between said stages arranged to limit forward and rearward movement of said stages relative to one another; and side-to-side guide rollers between said stages arranged to limit lateral movement of said stages relative to one another, said front-to-back guide rollers and side-to-side guide rollers being mounted on a said column section.

2. A multi-stage mast according to claim 1 in which said upright column section is hollow and generally rectangular in cross-section and said stages have a reeving system for extending and retracting said movable stages, said system including pulleys mounted on said stages and extending through cutouts in said column sections and including a cable passing around said pulleys and passing along the interior of said hollow upright column section.

3. In a multi-stage mast:

front and back mast stages having the same width and each having a central upright column section;

one of said stages presenting a pair of inwardly facing channels on opposite lateral sides, and the other of said stages having front-to-back guide rollers riding in said inwardly facing channels;

a pair of guide flanges projecting in the front or back direction from the column section of one of said stages, and the other of said stages having a side-to-side guide roller riding between said guide flanges.

4. In a multi-stage mast according to claim 3, said mast stages having the same lateral cross-section, said central column section being a generally rectangular hollow section to which said channels and guide flanges are integrally connected.

5. In a multi-stage mast according to claim 4, said side to side guide roller being mounted on a said central section.

6. In a multi-stage mast according to claim 4, each said central column section having front and back sides and having upper and lower ends, the front and back sides of said central column section in each stage having cutouts therethrough located adjacent the ends of the stages, and upper and lower pulleys mounted in each central column section to extend through respective of said cutouts and receive a hoisting cable reeved over the upper pulleys and under the lower pulleys and passing along the interior of said central column sections.

7. In a multi-stage mast;

a mast stage having a central hollow column with front and back walls connected by lateral walls, a pair of front channels connected to the front of said lateral walls and facing inwardly toward one another, a pair of outwardly facing flanges at the back of said lateral walls, a front pair of flanges projecting forwardly from said front wall, and a rear pair of flanges projecting rearwardly from said rear wall.

8. In a multi-stage mast according to claim 7, a side-to-side guide roller mounted on one of said front and back walls and projecting between and beyond the respective said front or rear pair of flanges.

9. In a multi-stage mast according to claim 8, a pair of front-to-back rollers mounted on said mast stage near one end thereof.

10. In a multi-stage mast according to claim 7, upper and lower cutouts in said central column, mounting blocks in said central column opposite said cutouts, each mounting block having a sloped outer face adjacent its respective cutout with the planes of said sloped faces being at cross-angles to one another, and respective pulleys mounted on said mounting blocks in parallel rotation to said sloped faces.

11. In a multi-stage mast according to claim 7, a second said mast stage like the first mentioned mast stage and arranged in front to back relation therewith, the said pair of outwardly facing flanges on said second mast stage extending into said front channels of said first mentioned mast stage.

12. A multi-stage hoist comprising a back stationary mast stage;

a front carriage;

multiple extensible mast stages arranged in interfitting front to back relationship between said carriage and back stage;

said stages having the same width and cross-section and having a central upright column section;

front-to-back guide rollers between said mast stages outwardly of the central column sections;

side-to-side guide rollers between said mast stages;

and a reeving system for vertically extending and retracting said extensible stages relative to said stationary stage and one another while guided by said front-to-back and side-to-side rollers.

13. A multi-stage hoist according to claim 12 in which each extensible mast stage has a pair of track flanges projecting from its central column section toward the adjoining mast stage, said side-to-side rollers being mounted on the central column section of said adjoining mast stages and projecting between respective of said pairs of track flanges.

* * * * *